United States Patent [19]

Watanabe et al.

[11] Patent Number: 4,762,061

[45] Date of Patent: Aug. 9, 1988

[54] METHOD OF PRODUCING COMPRESSED ROLL OF PAPER

[76] Inventors: Kouzou Watanabe, 18-25, Fukumitsu Minami-machi, Gifu-shi, Gifu-ken; Yasuhiko Saito, 13-17, Hiromi-Higashihoncho, Fuji-shi, Shizuoka-ken, both of Japan

[21] Appl. No.: 13,168

[22] Filed: Feb. 11, 1987

Related U.S. Application Data

[63] Continuation of Ser. No. 716,848, Mar. 28, 1985, abandoned.

[30] Foreign Application Priority Data

Mar. 30, 1984 [JP] Japan ..... 59-62293
Dec. 6, 1984 [JP] Japan ..... 59-258308

[51] Int. Cl.[4] ..... B30B 13/00

[52] U.S. Cl. ..... 100/35; 100/178; 100/214; 100/215; 53/439; 53/529

[58] Field of Search ..... 53/436, 438, 439, 441, 53/523, 526, 529, 530; 100/144, 155 R, 177, 178, 232, 233, 295, 35, 214, 215

[56] References Cited

U.S. PATENT DOCUMENTS

| | | | |
|---|---|---|---|
| 606,478 | 6/1898 | Tremaine et al. | 100/178 X |
| 2,504,993 | 4/1950 | Lobasso | 53/529 X |
| 3,123,958 | 3/1964 | Carruthers | 53/529 X |
| 3,476,037 | 11/1969 | Gorby | 53/529 X |
| 3,837,138 | 9/1974 | Terry | 53/439 |
| 4,166,140 | 8/1979 | Dutton et al. | 53/436 X |
| 4,258,766 | 3/1981 | van Dijk | 53/529 X |
| 4,341,056 | 7/1982 | Leanna et al. | 53/529 X |
| 4,408,438 | 10/1983 | Rewitzer | 100/295 X |
| 4,411,122 | 10/1983 | Cornish et al. | 53/438 X |
| 4,535,587 | 8/1985 | Rias | 53/436 |
| 4,550,550 | 11/1985 | Scott | 53/438 X |
| 4,602,472 | 7/1986 | Ampolini | 53/438 |
| 4,631,904 | 12/1986 | Nagata et al. | 53/529 |

FOREIGN PATENT DOCUMENTS

| | | | |
|---|---|---|---|
| 93837 | 11/1941 | Netherlands | 100/178 |
| 607085 | 10/1960 | United Kingdom | 53/523 |

*Primary Examiner*—Robert L. Spruill
*Assistant Examiner*—Steven P. Weihrouch
*Attorney, Agent, or Firm*—Kenyon & Kenyon

[57] ABSTRACT

This invention relates to compression of a paper roll for reducing a volume thereof. The paper roll is introduced into a receiver which includes side wall members disposed in parallel with each other and leaning a given space therebetween, a wall member spanning the space between the side wall members for bearing the paper roll during the compression thereof, and a compressing plate member disposed between said side wall member and connected to a pusher rod member. The paper roll is compressed by moving the compressing plate member toward the spanning wall member and is deformed into a flat shape until a diameter of the paper roll is reduced to a thickness within the range between one-half and one-fifth. A degree of the compression is regulated so that the volume reduction can be effectively obtained while it can be easily restituted to its original shape.

1 Claim, 2 Drawing Sheets

METHOD OF PRODUCING COMPRESSED ROLL OF PAPER

This application is a continuation of application Ser. No. 716,848 filed Mar. 28, 1985, now abandoned.

BACKGROUND OF THE INVENTION

1. Field of the Invention

The present invention relates to a method for compressing a roll of paper such as a toilet paper roll, a paper towel roll or the like for reduction of the volume thereof and more particularly to a method of producing such a compressed roll of paper and an apparatus therefor.

2. Description of the Prior Art

In general, a roll of paper such as a toilet paper roll, a paper towel roll or the like is formed into a cylindrical shape by winding a paper web on a cylindrical hollow core so that a desired length of the paper web can be continuously unwound and cut off for use from the roll of paper which is held by a holder.

Because of the cylindrical shape of the roll of paper and the exsistence of the hollow core therein, when the rolls of paper are packed in a corrugated box, for example, there remain many spaces among them so that the rolls of paper as packed are bulky. For this reason, conventional rolls of paper having the cylindrical shape are relatively costly to ship and store. As such shipping and storage costs are a significant factor in the unit cost of these rolls, it is desirable to reduce them. This is especially true if the rolls are to be exported since overseas shipping and storage charges are particularly high.

In order to eliminate the disadvantages resulting from the cylindrical shape of the conventional roll of paper, it has already been proposed that the cylindrical rolls of paper be compressed and deformed into a flat shape so that they have a reduced volume, whereby it is possible to reduce the shipping and storage charges per roll of paper.

However, none of the conventional proposals have been satisfactorily put to practical use up to now.

One reason has been that when the rolls are drastically compressed and deformed into a flat shape to obtain maximum volume reduction effect, it becomes impossible to completely return the flattened rolls to their original cylindrical shape because the crikles of the rolled paper are smoothed out at the sides thereof which are pressed out during the compression, because irregular wrinkles or creases occur in the pressed-out sides and/or because the rolls yield to the compression and lose their force of restitution. In general, since rolls of paper that have been deformed, as during the shipping for example, suffer a loss of a commercial value, the rolls of paper have to be compressed and deformed so that they can be returned to their original shape for use.

On the other hand, when the degree of the compression is regulated so that the rolls of paper can be easily returned to their original shape, it is impossible to obtain sufficient volume reduction effect because the compressed rolls have a tendency to return toward their original shape due to the force of restitution.

SUMMARY OF THE INVENTION

The present invention is directed to an improvement of the method of producing a compressed roll of paper and the apparatus therefor disclosed in Japanese Patent Application No. 58(1983)-91231 filed by the same applicant. This invention has been developed on the basis of research on the nature of the force of restitution in compressed rolls of paper.

It is a principal object of the present invention to provide a method of compressing and deforming a cylindrical roll of paper into a flat shape wherein the volume of the roll of paper can be satisfactorily reduced without any of the drawbacks as mentioned above and the flattened rolls of paper can be easily returned to their original shape in good condition.

It is a further object of the present invention to provide an apparatus for effectively carrying out the above-mentioned method.

In order to achieve the principal object of the present invention, there is provided a method of producing a compressed roll of paper, which comprises the steps of: applying a compressing pressure to a cylindrical roll of paper to deform it into a flat shape; and continuing application of the compressing pressure to said roll of paper until the diameter thereof is reduced to between one-half and one-fifth the diameter before compression. According to the present invention, there is also provided a method of producing a compressed roll of paper, which comprises the steps of: applying a compressing pressure to a cylindrial roll of paper to deform it into a flat shape while exerting a pressure on the pressed-out sides of the deformed roll of paper during the compression thereof; and continuing application of the compressing pressure to said roll of paper until the diameter thereof is reduced to between one-half and one-fifth the diameter before compression.

In the present invention, after the roll of paper is compressed and deformed into the flat shape, it may be covered with a heat-shrinkable polymer film. In this case, by heating the heat-shrinkable polymer film, the flat shape is positively maintained.

The term "compressed roll of paper" as used herein is defined to include compressed rolls of toilet paper and compressed rolls of paper towel. Moreover, the roll of paper may be a long roll to be cut into two or more unit rolls each the size of the final product roll after it has been compressed and deformed into the flat shape. In this case, the long roll of paper may be provided with one or more perforated lines or the like by which the unit rolls are defined, whereby it can be easily cut and separated into the unit rolls.

The roll of paper need not necessarily include a cylindrical hollow core on which the paper web is wound. In the case where the hollow core is used, however, it is preferably formed of a suitable material having some degree of elasticity, such as a gum resin, a plastic material or the like so that when the compressed roll of paper including the hollow core (which is also deformed into the flat shape) is returned to the original cylindrical shape for use by pushing the pressed-out sides thereof with hands, the deformed hollow core can also be easily returned to the original cylindrical shape. On the other hand, the hollow core may be even formed of a deformable material such as thin paper board of the type used in conventional toilet paper rolls. When the hollow core formed of the thin paper board is deformed into the flat shape, wrinkles or creases occur in its pressed-out sides. However, when the compressed roll of paper is returned to its original cylindrical shape, the deformed hollow core can also be easily returned to its original cylindrical shape by exerting a pressure upon the pressed-out sides thereof.

The flat shape of the compressed roll of paper produced according to the present invention has an oval cross section which varies somewhat depending upon the compression conditions of the roll of paper and/or the degree to which the rolled paper web is creped. The oval cross section further varies depending upon the kind of the rolled paper web (on whether it is of single-ply type or double-ply type) and/or upon the compressing process used (on whether or not a pressure is exerted on the pressed-out sides of the deformed roll of paper during the compression thereof).

In one aspect of the present invention, the roll of paper is compressed and deformed into a flat shape without exerting a pressure on the sides of the paper roll, which are pressed out during the compression thereof. For example, when rolls of double-ply toilet paper having a diameter of 105 millimeters and a paper web width of 114 millimeters (this roll is obtained by winding 65 meters of double-ply paper web on a cylindrical hollow core with a diameter of 38 millimeters), which were selected as a first sample among various types of commercially available toilet paper rolls, were compressed and deformed into a flat shape without exerting a pressure on the sides of the toilet paper roll, there could be obtained flattened toilet paper rolls having various oval cross sections with thicknesses (minor diameters) of less than about 60 millimeters and major diameters of more than about 135 millimeters. The major diameter of the hollow cores was more than 59 millimeters. Among these flattened toilet paper rolls, those having a minor diameter of less than 50 millimeters and a major diameter of more than 130 millimeters (the hollow core having a major diameter of 60 millimeters) were selected as preferable compressed rolls in view of their good volume reduction effect and the ease with which they could be restored to their original shape.

In another aspect of the present invention, the roll of paper is compressed and deformed into a flat shape, with a pressure being exerted on the sides of the paper roll. For example, when rolls of single-ply toilet paper having a diameter of 100 millimeters (this roll is obtained by winding 55 meters of single-ply paper web on a cylindrical hollow core with diameter of 38 millimeters), which were selected as a second sample among various commercially available toilet paper rolls, were compressed and deformed into a flat shape with a pressure being exerted on the sides of the toilet paper roll, there could be obtained flattened toilet paper rolls having various oval cross sections with thicknesses (minor diameters) of less than about 67 millimeters and major diameters of more than about 117 millimeters, the major diameter of the hollow core being more than 59 millimeters. Among these flattened toilet paper rolls, those having a minor diameter of less than about 50 millimeters and a major diameter of more than about 124 millimeters (the hollow core having a major diameter of more than 60 millimeters and a minor diameter of less than about 50 millimeters) were selected as preferable compressed rolls in view of their good volume reduction effect and the ease with which they could be restored to their original shape.

As the restorability of a flattened toilet paper roll mainly depends upon an elasticity deriving from the crinkles in the creped toilet paper web, the compressing process has to be performed in such a manner that these crinkles are not smoothed out during the compression of the toilet paper roll. If the toilet paper roll is excessively compressed and deformed, the crinkles are smoothed out at the sides of the compressed paper roll which are pressed out perpendicularly to the compressing direction, whereby the elasticity and the softness of the toilet paper web are lost.

Thus, in the present invention, the degree of compression of the toilet paper roll is regulated so that as much as possible the smoothing-out of the crinkles can be avoided at the pressed-out sides of the paper roll during the compression. That is, by regulation of the degree of compression it is possible to prevent the crinkles from being smoothed out at the pressed-out sides to such a degree that the flattened toilet paper roll cannot be restored to its original cylindrical shape. According to this regulation, it is possible to compress and deform the first 65 m double-ply sample roll to a diameter of 20 millimeters. On the other hand, if in the case of the second 55 m single-ply sample roll, a pressure is exerted on the sides of the roll during the compression so as to avoid the smoothing-out of the crinkles at the pressed-out sides as much as possible, it is possible to compress and deform the roll to a diameter of 27 millimeters.

Although the compressed toilet paper rolls obtained as described above have some tendency toward returning to their original shape they nevertheless remain substantially flat. For example, in accordance with the above-mentioned methods, the first sample roll can be obtained as a flattened paper roll having a minor diameter of less than about 55 (preferably 50) millimeters and a major diameter of more than about 130 millimeters, and the second sample roll can be obtained as a flattened paper roll having a minor diameter of less than about 50 (preferably 45) millimeters and a major diameter of more than about 124 millimeters.

On the other hand, extreme compression and deformation of the first and second sample rolls at a single stroke so as to reduce the diameter thereof to, for example, 10 millimeters should be avoided because when a perforated line formed on the paper web for cutting off a suitable length thereof falls at one of the pressed-out sides of the compressed toilet paper roll, the paper web may be torn along the perforated line during the compression, because irregular wrinkles or creases occur at the pressed-out side portions so that it is difficult to return the flattened roll to its original shape, and because the layers of the rolled paper web are jammed up at the rim portions so that the paper web tends to be torn from the rim portions when it is unwound from the roll. In order to avoid these troubles, the first and second sample rolls may, for example, be compressed and defomed to a minor diameter between 20 to 30 millimeters, preferably, about 27 millimeters, and the compressed paper roll may be then covered with a heat-shrinkable polymer film so that it can be further compressed and deformed into a predetermined flat shape by heating the heat-shrinkable polymer film. In accordance with this method, it is possible to compress and deform the paper rolls into a desired flat shape without tearing the rolled paper web along perforated lines located at the pressed-out sides, during the compression. Furthermore, in the flattened paper rolls which are obtained by this method, the paper web is not torn from the rim portions of the paper roll during the unwinding of the paper web from the paper roll, since jamming of the rim portions of the rolled paper web can be avoided.

In all events, in order to positively maintain the flat shape of the compressed paper rolls having the self-restorability, they are preferably wrapped in a plastic film or the like just, individually or in groupe, after the compression. Alternatively, it is of course possible to pack the flattened paper rolls in a container such as a corrugated box, a plastic box, a can or the like, whereby the flat shape thereof can be positively maintained. However, in view of the fact that the wrapping of the flattened paper rolls in plastic film can be easily mechanized, and that the air-tight and/or water-tight seal resulting form the plastic film-wrapping can prevent the flattened paper rolls from being soilded and deteriorated due to exposure to rain, moisture and the like during shipping and storage, it is expedient to use plastic film-wrapping. Furthermore, in the case where the flattened paper rolls are wrapped in plastic film, it is preferable to simultaneously carry out the compressing and wrapping processes under vacuum condition because this allows conventional rolls of paper to be compressed so that the volume thereof is reduced to one-half and because the flattened paper rolls so obtained have a relatively large restorability for the high volume reduction effect obtained. In addition, it is preferable to use a heat-shrinkable polymer film as the plastic film because the pressure formation can then be carried out simultaneously with the wrapping.

According to the present invention, there is also provided an apparatus for producing a compressed roll of paper, which comprises: a receiver for accommodating a cylindrical roll of paper to be compressed, said receiver including side wall members disposed in parallel with a given space therebetween, a wall member spanning the space between said side wall members for bearing the roll of paper during the compression thereof, and a compressing plate member disposed between said side wall members so that it can be moved toward and away from said spanning wall member; a pusher rod member one end of which is connected to said compressing plate member; means for driving said pusher rod member to move said compressing plate member toward and away from said spanning wall member; and means for positioning the roll of paper within said receiver, said positioning means being provided in at least one of said side wall members. According to the present invention, there is further provided an apparatus for producing a compressed roll of paper, which comprises: a drum-like member rotatably mounted on a fixed shaft; driving means for rotating said drum-like member about said fixed shaft; at least one receiver radially supported by said drum-like member for accommodating a cylindrical roll of paper, said receiver including side wall members disposed in parallel with a given space therebetween, a wall member spanning the space between said side wall members for bearing the roll of paper during the compression thereof, and a compressing plate member disposed between said side wall members so that it can be moved toward and away from said spanning wall member; pusher rod members each having one end connected to one of said compressing plate members; a cam member engaged with the other ends of said pusher rod members during the rotation of said drum-like member to move said compressing plate members toward and away from said spanning wall member; and means for positioning the roll of paper within each receiver, said positioning means being provided in at least one of said side wall members of said each receiver.

In the present invention, said cam member may be mounted on said fixed shaft. In this case, the cam member has a cam surface surrounding said fixed shaft, and said pusher rod members are perpendicularly disposed with respect to the longitudinal axis of said fixed shaft so that the other ends of said pusher rod members are engaged with said cam surface. On the other hand, said cam member may comprise a disc-like plate which is concentrically disposed with respect to said drum-like membr and which has a cam surface at its one end face opposed to the corresponding end face of said drum-like member, and said pusher rod members are disposed in parallel with the longitudinal axis of said fixed shaft so that the other ends of said pusher rod members are engaged with said cam surface.

Said spanning wall member may comprise a lid member which is pivoted to one of said side wall members and which is movable between an open position where the cylindrical roll of paper can be introduced into said receiver and a closed position where said lid member offers a bearing surface to the roll of paper during the compression thereof.

In the case where pressure is exerted on the pressed-out sides of the paper roll during the compression thereof, the exertion of pressure can be accomplished by utilizing the side wall members of the receiver. In particular, the paper roll is disposed between the side wall members so that the longitudinal axis thereof is in parallel with the wall surfaces of the side wall members, and the space between the wall surfaces is selected so that the pressed-out sides of the paper roll bear against the wall surfaces during the compression thereof whereby the desired pressure is applied as a reaction to the pressed-out sides of the paper roll during the compression thereof.

On the other hand, in the case where the paper roll is compressed without exerting the pressure on the pressed-out sides of the paper roll, the receiver is designed so that when the paper roll is compressed, the sides of the paper roll which are perpendicular to the compressing direction can be freely pressed out during the compression. For example, when the paper roll is disposed between the side wall members so that the longitudinal axis thereof is in parallel with the wall surfaces of the side wall members, the space between the wall surfaces may be selected so that the pressed-out sides of the paper roll do not contact with the wall surfaces during the compression thereof. Alternatively, the paper roll may be disposed between the side wall members so that the longitudinal axis thereof is perpendicular to the wall surfaces of the side wall members. In this case, the opposite sides which are perpendicular to the side wall members may be opened so that the sides of the paper roll which are perpendicular to the compressing direction can be freely pressed out during the compression. Also, a wall surface which does not contact with the pressed-out sides of the paper roll during the compression may be formed in one or both of the opposite sides which are perpendicular to the side wall members.

When the compression of the paper roll is carried out by the pusher rod, the compressing stroke of the pusher rod of course has to be suitably selected for obtaining a flattened paper roll of the desired dimension. For example, in order to obtain a flatted paper roll having a minor diameter of about 50 millimeters from the first and second sample rolls mentioned above, the compressing stroke of the pusher rod is about 83 millimeters so that the roll is once compressed and deformed into the flat shape having a minor diameter 20 to 30 millimeters (preferably 27 millimeters). In other words, in order to obtain a final flattened paper roll having a minor diameter of about 50 millimeters, the roll has to be compressed so that the diameter thereof is reduced to 27 millimeters or so. In this case, the paper roll cannot be compressed in a single stroke but has to be compressed slowly by degree so as to reduce the diameter thereof to 27 millimeters or so. Furthermore, after the paper roll has been compressed to a diameter within the range from 20 to 30 millimeters, for example, 27 millimeters, the pusher rod should not be returned immediately but should maintain the compressed paper roll under the compressing pressure for a predetermined period of time, for example, 15 seconds or more, preferably 20 seconds or more. Thereafter, the compressing pressure may be gradually released from the compressed paper roll or the compressed paper roll may be further maintained under the final compressing pressure until it is discharged from the receiver. According to this method, when the compressing pressure is ultimately released, the reduced diameter of the compressed paper roll springs back only to 50 millimeters or so so that the flattened paper roll stably maintains its shape, making it easy to carry out subsequent processes.

On the contrary, in the case where a first or second sample roll is compressed to a minor diameter of 10 millimeters, after the compressing pressure is released, the reduced diameter thereof returns to 26 millimeters. That is, the flattened paper roll so obtained has a minor diameter of 26 millimeters. However, it is impossible to easily restore the flattened paper roll to its original cylindrical shape because wrinkles or creases occur at its pressed-out sides. Also, in the case where the roll is compressed to a diameter of 16 millimeters, after the compressing pressure is released, the reduced diameter thereof returns to 27 millimeters. Again, however, the flattened roll cannot easily be restored to its original shape. Accordingly, it has been found that the compression condition must be such that after the compressing pressure is released from the compressed paper roll, the reduced diameter thereof returns to a thickness within the range from 45 to 50 millimeters or so.

As stated in the foregoing, it is possible to wrap up and seal one or more of the flattened paper rolls in a plastic film simultaneously with the press formation thereof. However, it is of course possible to carry out the wrapping process independently of the press formation. Furthermore, it is possible to wrap up and seal in the plastic film either one or more unit rolls or one or more flattened long paper rolls, of a length equal to two or more unit rolls.

In the compressing apparatuses constructed in accordance with the present invention, each pusher rod may have at one end a roller which is engaged with the cam member so that the compressing stroke of the pusher rod is controlled for carrying out a predetermined compressing process. The receiver for accommodating the paper roll may be circulated along a horizontal or vertical path which is formed by the cam member, so that the compressing process is carried out by the pusher rod during the circulation of the receiver. Preferably, the cam member is securely mounted on the fixed shaft and the receivers are radially disposed and circulated around the cam member along a vertical path. With this arrangement wherein the cam member is secured on the fixed shaft, the construction of the compressing apparatus can be simplified and the space required for installation thereof can be reduced. In all events, the profile of the cam member is defined so that a predetermined compressing stroke is carried out by the pusher rod.

The spanning wall member for bearing the paper roll during the compression may be formed as a lid member which is pivoted to one of the side wall members. By using the lid member, the paper roll to be compressed can be introduced into the receiver and the compressed paper roll can be discharged therefrom. Preferably, the positioning means is provided in at least one of the side wall members so that the paper roll to be compressed is set in position within the receiver.

When the spanning wall member is formed as the lid member, the lid member may be held in its closed position by means of a suitable latch member during the compression. The lid member is provided with a roller which contacts a bearing surface formed on the frame structure during the compression so that the bearing surface bears up against the compressing force.

Particularly, when a rotary type compressing apparatus is constructed, a cam rail may be disposed along a portion of the cam member so as to engage with the roller of the pusher rod. The cam rail is used to return the pusher rod to its initial position after the compression. Also, another cam rail may be disposed along a portion of the circular path of the receivers so as to engage with the lid member of the each receiver. This cam rail is used to move the lid member to its closed position before the compression.

The above and other advantages of the present invention will become more apparent from the following discription and the accompanying drawings. It is to be understood, however, that the drawings are not intended as a definition of the limits of the present invention.

DESCRIPTION OF THE PREFERRED EMBODIMENT

Figure 1:
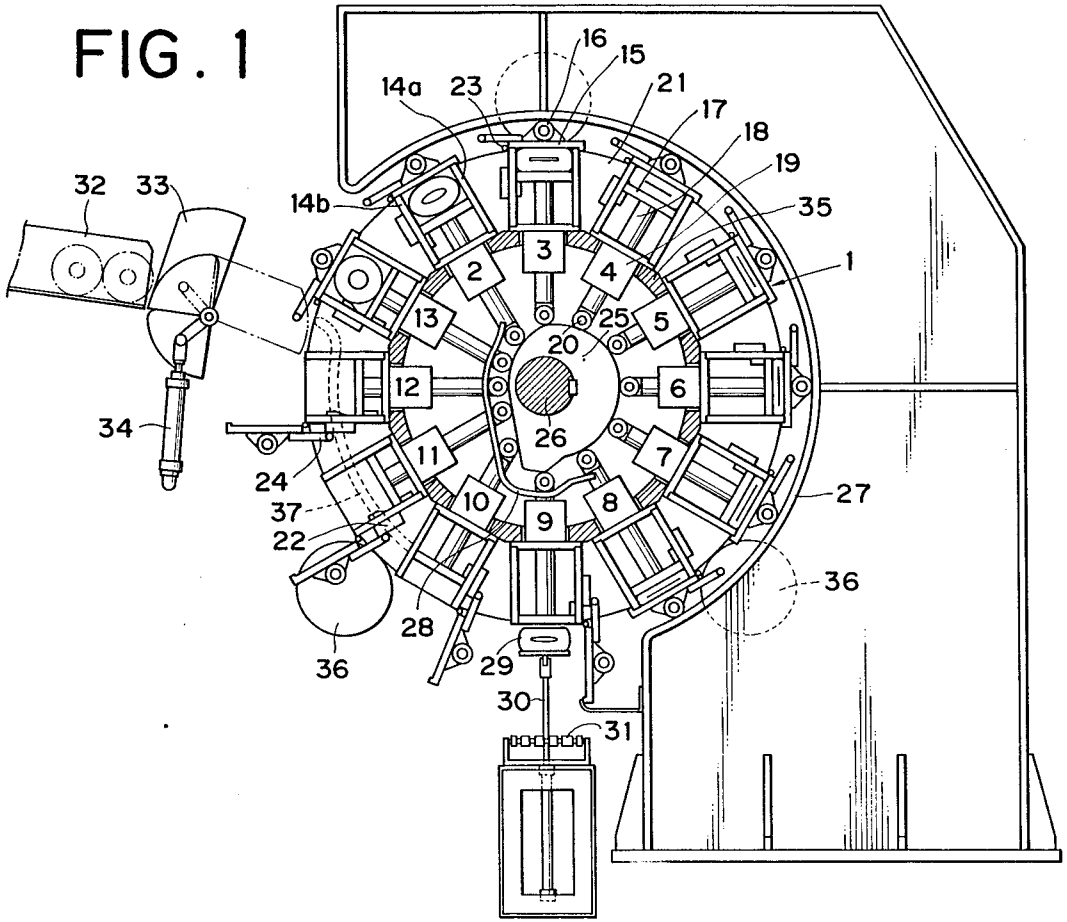
FIG. 1 is an elevational view of a compressing apparatus according to the present invention.

Referring now to the drawings and more particularly to FIG. 1, an apparatus according to this invention comprises at least one device for receiving and compressing a roll of paper (called a "receiver" herein and generally indicated by the reference numeral 1), which roll of paper is a toilet paper roll in this embodiment. In the illustrated embodiment, twelve receivers 1, which are numbered by numerals 2 to 13, are radially disposed and can be continuously rotated in the clockwise direction. Each receiver 1 includes a pair of opposite side wall members **14*a* and 14*b*, a lid member 15 with a cam follower 16 of roller type, a compressing wall member 17, a rod member 18 one end of which is connected to the compressing wall member 17 and the other end of which has a cam follower 20 of roller type, and a bearing 19 for the rod member 18**.

The opposite side wall members **14*a* and 14*b* are secured to a drum end plate 21 of a drum 35 which is rotatably supported by rollers 36, and are formed with a space therebetween for receiving the toilet paper roll to be compressed. Means for positioning the paper roll is incorporated in the side wall member 14*b* and includes a stopper element 22 which is movably disposed within an opening formed in the side wall member 14*b* and which is biased by springs 38, whereby the paper roll is held in position within the receiver 1. At least one of the rollers 36** is driven by, for example, an electric motor (not shown).

Figure 2:
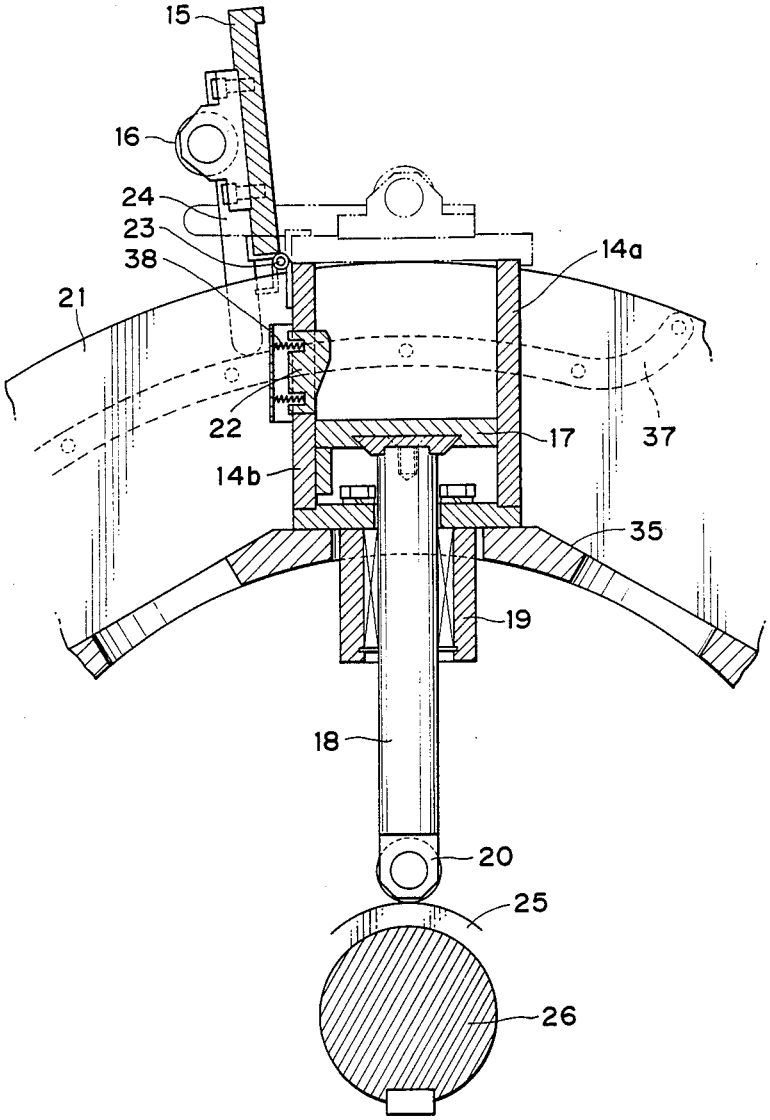
FIG. 2 is an enlarged sectional view of one part of the apparatus of FIG. 1.

The lid member 15 is pivotally mounted on a pivot pin 23 which is provided on the outer end of the side wall member **14*b*, as shown in FIG. 2. The lid member 15 has a lever arm 24 which serves to close the lid member 15** as will be explained more fully hereinafter.

The rod member 18 is movably supported by the bearing 19 so that the compressing wall member 17 connected to the one end of the rod member 18 serves to compress the paper roll charged in the receiver 1. In particular, the drum end plate 21 is concentrically and movably mounted on a fixed shaft 26 and is rotated together with the twelve receivers 1 in the clock-wise direction, whereby the rod member 18 is operated to compress the paper by engagement of the cam follower 20 with a cam member 25 which is securely mounted on the fixed shaft 26.

The cam follower 16 of the lid member 15 is engaged with a bearing surface 27 which is formed on the frame structure along a portion of the circular path of the receivers 1. When the cam follower 16 is in contact with the bearing surface 27, the lid member 15 is securely held in its closed position so that it serves to bear up the paper roll during the compression, with the bearing surface 27 bearing up against the compressing force. In particular, in FIG. 1, the cam followers 16 of the receivers numbered 2 to 8 are in contact with the bearing surface 27; the receiver numbered 2 is at the initial stage of the compressing process; the receivers numbered 3 to 7 are in course of the compressing process; and the receiver numbered 8 is at the stage immediately following completion of the compressing process.

On the other hand, the cam followers 16 of the receivers numbered 9 to 13 are in engagement with a cam rail 28. The cam follower 16 of the receiver numbered 9 has just disengaged from the bearing surface 27 so that the lid member thereof opens under its own weight, whereby the compressed paper roll 29 is forcedly discharged form the receiver by a slight pushing movement of the rod member 18 which results from the passage of the cam follower 20 over a projected profile portion of the cam member 25. As shown in FIG. 1, the discharged paper roll 29 is deposited on an elevator 30 which can go up and down, and is then fed to a conveyor 31 which is associated with the elevator 30. The empty receivers numbered 10 to 12 are successively moved toward a position where a new toilet paper roll is fed thereto, the rod members 18 thereof being returned to their initial positions by the cam rail 28 with which the cam followers 20 thereof are engaged. The receiver numbered 12 is just ready to receive the new paper roll which will be fed thereto through a feeder 32. The feeder 32 includes a pivoted chute 33 which can be moved by a piston-cylinder device 34 between a stop position shown by the solid line and a open position shown by the phantom line (FIG. 1). There is provided another cam rail 37 which is disposed adjacent the position where the new paper roll is fed to the empty receiver. As best shown in FIG. 2, the cam rail 37 includes an arcuate portion with which the lever arm 24 of the lid member engages perpendicular to the tangential direction of the arcuate portion to hold the lid member substantially parallel with the side wall member **14*b*, and a bent portion with which the lever arm 24 engages to return the lid member to its closed position. The lid member of the receiver numbered 13** has just been closed by the engagement of the lever arm thereof with the bent portion.

The profile of the cam member 25 is determined relative to various parameters. For example, the profile can be selected so that: the rod member 18 is gradually inserted into the receiver 1 at an average rate of 4.3 millimeters per a second to compress the paper roll; the compressing wall member 17 is moved toward the closed lid member by the rod number over a distance within the range from 15 to 25 millimeters as measured from the inner wall surface of the lid member; and the compressing wall member 17 is stopped at said distance and then remains at the stopped position for 17.5 seconds.

In the above embodiment, the pressed-out sides of the paper roll contact the side wall members **14*a* and 14*b*** during the compression thereof so that a pressure is exerted upon the pressed-out sides of the paper roll. On the other hand, as previously mentioned, the paper roll can also be compressed without exerting a pressure upon the pressed-out sides of the paper roll during the compression thereof. In this case, the space between the side wall members may be widened so that the pressed-out sides of the paper roll do not make contact with the wall surfaces of the side wall members. Alternatively, the paper roll may be disposed within the receiver so that the longitudinal axis thereof is perpendicular to the wall surfaces of the side wall members.

The compressed paper roll obtained using the compressing apparatus described above can, for example, be wrapped in a heat-shrinkable polymer film with a thickness of 0.02 millimeters, for example. In this case, when the heat-shrinkable polymer film is heated to 200° C., the flattened paper roll is further compressed by the plastic film while being sealed thereby.

It should be understood that the compressing apparatus may be modified so that a long paper roll having a length equal to two or more unit rolls can be compressed in the same manner. In this case, the compressed long paper roll may be cut into unit rolls before the wrapping process. On the other hand, when perforated lines are formed in the compressed long paper roll so that unit rolls can be cut therefrom, the long roll itself may be wrapped in the plastic film.

In the case where the first 65 m double-ply sample rolls are processed and sealed in the manner described above, it is possible to obtain a flattened paper roll having a minor diameter of about 50 millimeters and a major diameter of about 135 millimeters. A conventional case or box which can hold 120 of the first sample rolls before compression will be able to hold 208 flattened paper rolls obtained by compressing the first sample rolls. In other words, the packing density is increased by 73.3%.

On the other hand, in the case where the second 55 m single-ply sample paper rolls are processed and sealed in the manner described above, it is possible to obtain flattened paper rolls having a minor diameter of about 50 millimeters and a major diameter of about 124 millimeters. In this case, too. A conventional case or box which can hold 120 of the second sample rolls before compression will be able to hold 208 flattened paper rolls obtained by compressing the second sample rolls so that the packing density is increased by 76.4%.

Accordingly, shipping and storage costs can be considerably reduced. If a case especially designed to enable optimum packing of the flattened rolls is used an even greater reduction of costs can be realized.

Furthermore, according to the present invention, after the compressing pressure is released from the compressed paper roll, there is some tendency for the roll to return toward its original shape. However, the flat shape is still substantially maintained so that the roll is effectively reduced in volume but can be easily restored to its original shape for use.

What is claimed is:

1. A method of producing a compressed roll of roll paper with preserved crepe deformed into a flat shape comprising the steps of:

applying a compressing pressure to a cylindrical roll of roll paper with crepe having an axis and a diametrical thickness, the compressing pressure being in one direction to deform said roll into a flat shape having a second thickness in said direction; and continuing application of said compressing pressure to said flat shape until said second thickness is reduced to between one-half and one-fifth of said diametrical distance of said cylindrical roll of roll paper before compression, while simultaneously restricting expansion of said roll in a direction lateral to said one direction of compressing pressure to at least partially preserve the crepe, said directions being substantially perpendicular to said axis of said roll.

* * * * *

UNITED STATES PATENT AND TRADEMARK OFFICE

CERTIFICATE OF CORRECTION

PATENT NO. : 4,762,061

DATED : August 9, 1988

INVENTOR(S) : Kouzou Watanabe and Yasuhiko Saito

It is certified that error appears in the above-identified patent and that said Letters Patent is hereby corrected as shown below:

In the Abstract, line 4, change "leaning" to --leaving--.

Column 1, line 47, change "crikles" to --crinkles--.

Column 5, line 1, change "groupe," to --groups--;

line 10, change "soilded" to --soiled--.

Column 6, line 7, change "membr" to --member--.

Column 10, line 9, change "number" to --member--;

line 60, change "..., too. A conventional..." to --..., too, a conventional...--.

Signed and Sealed this

Seventeenth Day of January, 1989

*Attest:*

DONALD J. QUIGG

*Attesting Officer*

*Commissioner of Patents and Trademarks*